US007086541B2

(12) United States Patent
Robertson

(10) Patent No.: US 7,086,541 B2
(45) Date of Patent: Aug. 8, 2006

(54) FLEXIBLE FRONT MERCHANDISING DISPLAY DEVICE

(75) Inventor: James David Robertson, Atlanta, GA (US)

(73) Assignee: Display Industries, LLC, Norcross, GA (US)

( * ) Notice: Subject to any disclaimer, the term of this patent is extended or adjusted under 35 U.S.C. 154(b) by 341 days.

(21) Appl. No.: 10/769,964

(22) Filed: Feb. 2, 2004

(65) Prior Publication Data

US 2005/0167377 A1 Aug. 4, 2005

(51) Int. Cl.
*A47F 1/04* (2006.01)

(52) U.S. Cl. ..... 211/59.3; 211/59.3; 211/51; 211/59.2; 211/59.4; 312/61; 312/71

(58) Field of Classification Search ..... 211/59.3, 211/59.2, 51, 59.4, 184; 312/61, 71; 206/817; 221/92; 108/60, 61
See application file for complete search history.

(56) References Cited

U.S. PATENT DOCUMENTS 2,855,258 A * 10/1958 Moncier ..... 312/140.3
4,759,449 A * 7/1988 Gold ..... 211/43
4,942,968 A * 7/1990 Fast ..... 211/184
5,240,126 A * 8/1993 Foster et al. ..... 211/59.3
5,562,217 A * 10/1996 Salveson et al. ..... 211/59.3
5,634,564 A * 6/1997 Spamer et al. ..... 211/59.3
6,129,218 A * 10/2000 Henry et al. ..... 211/59.3
6,142,316 A * 11/2000 Harbour et al. ..... 211/59.2
6,419,099 B1 * 7/2002 Weber ..... 211/184
6,439,401 B1 * 8/2002 Battaglia et al. ..... 211/59.2
2002/0179556 A1 * 12/2002 Osawa ..... 211/184

* cited by examiner

*Primary Examiner*—Richard E. Chilcot, Jr.
*Assistant Examiner*—Lindsay M. Maguire
(74) *Attorney, Agent, or Firm*—John L. James

(57) ABSTRACT

A merchandising device displays a column of articles having a lead article with a front contour. The device includes a base member with first second and third columns of slots. A first side panel has a plurality of downwardly extending feet protruding through slots in the first column connecting the first side panel to the base member. A first post attached to the first side panel. A second side panel, spaced from the first side panel, has a plurality of downwardly extending feet protruding through slots in one of the second and third second columns to connect the second side panel to the base member. A second post is attached to the second side panel. A flexible front stop member is attached to the first and second posts. The front stop member is greater in length than the spacing between the first and second posts to adopt the contour of the lead article.

15 Claims, 4 Drawing Sheets

FLEXIBLE FRONT MERCHANDISING DISPLAY DEVICE

TECHNICAL FIELD OF THE INVENTION

This invention relates to a display device useful in merchandising articles, and, more particularly, to a shelf device having a front stop member adapted to fit the contour of the bottles.

BACKGROUND OF THE INVENTION

Articles for sale are more appealing when articles are displayed in a neat and orderly manner. Merchandising display shelves are used to enhance appeal by promoting order. Some articles can be arranged neatly in stacks on the shelves, while other articles can be arranged in orderly rows. Unfortunately shoppers have a tendency to topple neat stacks and dishevel orderly rows thereby requiring an attendant to restore order to the articles which is not only time consuming but costly as well. Also, restoring order often places the attendant in a shopper's path creating a nuisance making shopping less efficient. It is desirable to have a merchandising device that helps maintain the articles in an attractive arrangement.

In refrigerator and freezer units in supermarkets and other stores, articles, such as beverage containers for example, are often stacked on wire shelves. It does not take very long for the articles to become disheveled as a shopper removes articles from the rear or as close to the rear as is reachable in an effort to obtain the coldest or freshest container. There are track devices for dividing a wide shelf into narrower channels which help keeps articles in orderly rows. The channels have a fixed width to fit a certain container size and also have a curved front with a diameter to fit a certain container size so that a track device is limited to use with one container size. Accordingly, it will be appreciated that it would be highly desirable to have a display shelf device that has a front stop member with the capability to accommodate different sized containers.

Many shelf devices depend on gravity feed to advance articles forward for removal which is undesirable. There are pusher devices that push articles on a shelf forward for easy removal, but many of these devices inhibit ventilation which is required to keep articles chilled. Some devices only push the articles forward without addressing dividing the articles into rows. Some pusher devices disclosed in U.S. Pat. Nos. 5,562,217 and 5,634,564 are specifically designed to push beverage bottles forward in a channel limited to one bottle size. Accordingly, it will be appreciated that it would be highly desirable to have a pusher device that pushes a row of beverage containers forward without inhibiting ventilation.

SUMMARY OF THE INVENTION

The present invention is directed to overcoming one or more of the problems set forth above. Briefly summarized, according to one aspect of the present invention, a merchandising display shelf track device is adapted to receive articles for sliding movement therealong and dispensing the articles one at a time. The merchandising display shelf track device displays a column of articles having a lead article with a front contour. The device includes a base member with first second and third columns of slots. A first side panel has a plurality of downwardly extending feet protruding through slots in the first column connecting the first side panel to the base member. A first post attached to the first side panel. A second side panel, spaced from the first side panel, has a plurality of downwardly extending feet protruding through slots in one of the second and third second columns to connect the second side panel to the base member. A second post is attached to the second side panel. A flexible front stop member is attached to the first and second posts.

Having the front stop member greater in length than the spacing between the first and second posts allows the stop member to adopt contour of the lead article and thereby accommodate articles of different sizes when the front stop member is extremely flexible. When the front stop member is a resilient curved member, the diameter of the curve changes when the second side panel and second post are moved from the second column of slots to the third column of slots. A single track device is thus able to accommodate beverage containers of different diameters.

Track devices can be placed side by side to accommodate multiple columns of beverage containers. Two track devices can be joined to one another using dual front slots in the second upright post to attach two front stop members. Dual side panels can be attached using dual rear slots or a single side panel can be used between columns of articles. Multiple track devices can be constructed where both posts are slotted.

A pusher mechanism can be attached to the base member or to a side panel to push articles forward for easy removal. A push out tab is used in the absence of a pusher mechanism to prevent articles from being pushed backward off the shelf.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
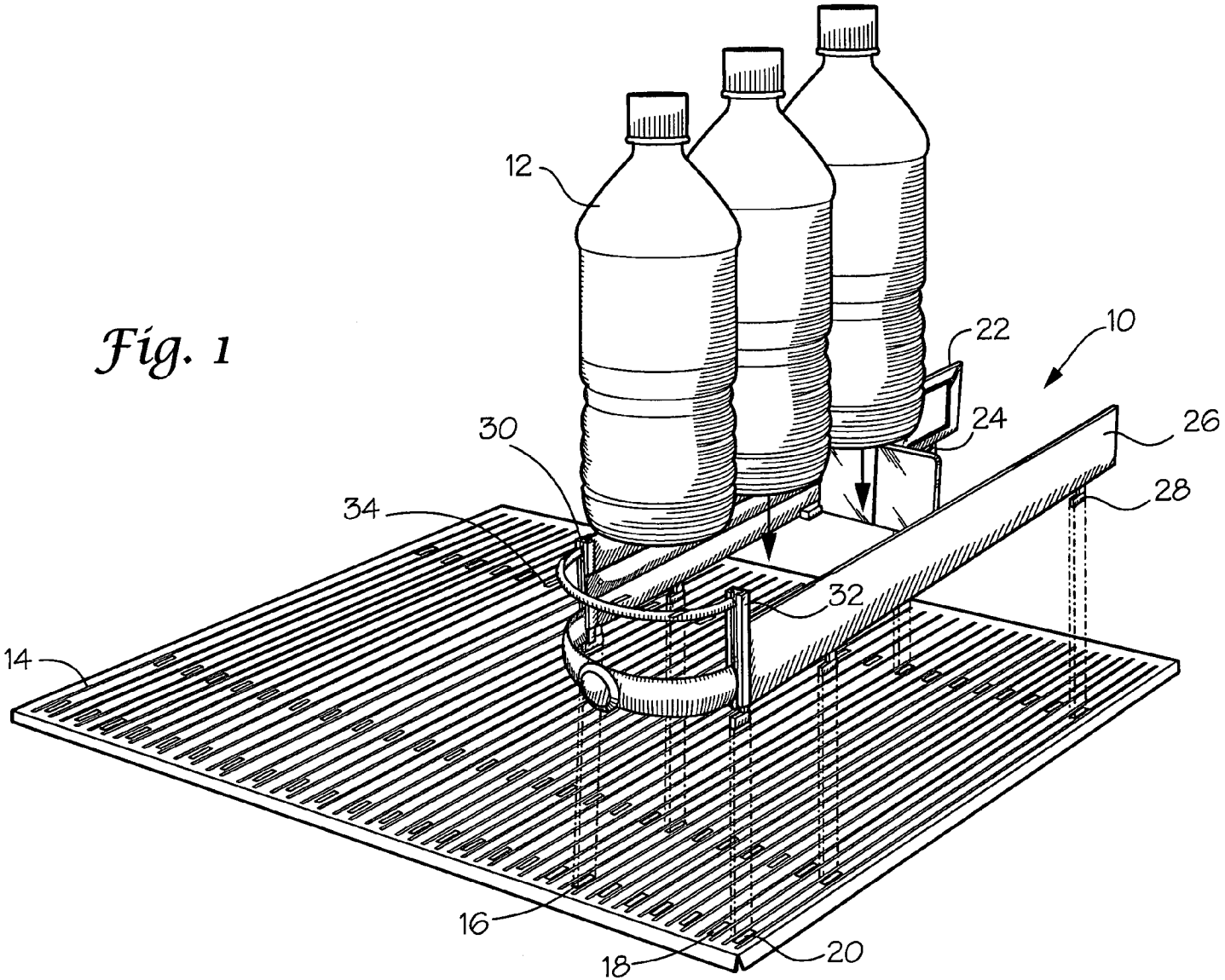
FIG. 1 is a diagrammatic exploded perspective view of a preferred embodiment of a flexible track device according to the present invention.
Figure 2:
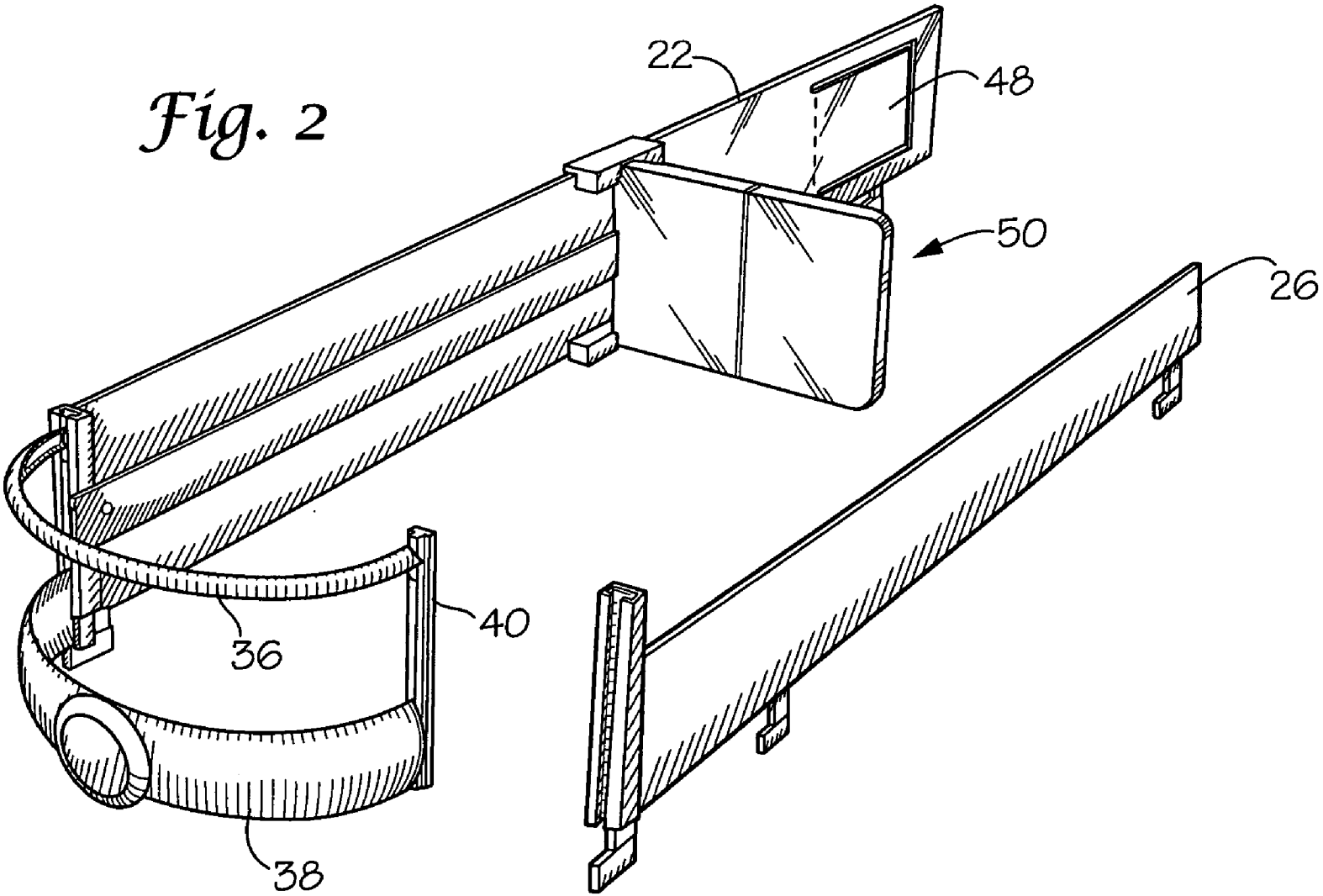
FIG. 2 is a diagrammatic exploded perspective view of the sidewalls and front stop member of the device of FIG. 1 with a side panel pusher mechanism.
Figures 4, 5, 6:
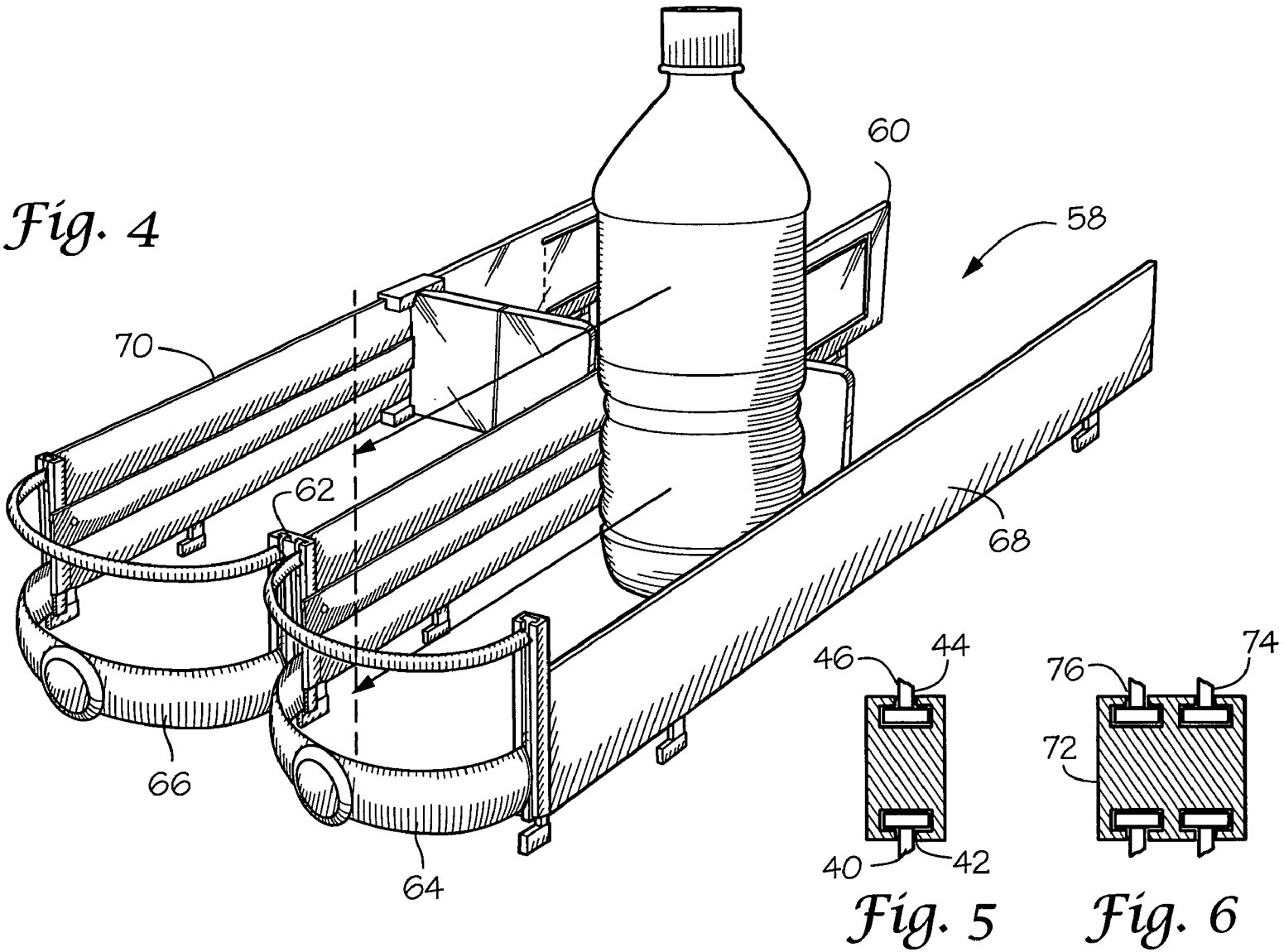
FIG. 4 is a perspective view similar to FIG. 1 but illustrating a plurality of track devices attached side by side.
FIG. 5 is a top view of a connecting post for a single side panel.
FIG. 6 is a top view of a connecting post for dual side panels.

Referring to FIGS. 1–2 and 5, a merchandising display device 10 displays a column of articles such as beverage bottles 12. Each bottle 12 in the column is cylindrical in configuration and has a front contour. The display device can fit on a wire, glass or plastic shelf of a refrigerator unit. The device has a base member 14 having front and rear portions, opposed side edge portions and a plurality of slots over the entire field of base member or where desired. Where ventilation is needed, the slots extend over the entire surface of the base member to improve air circulation. The slots are preferably rectangular in configuration. Base member 14 preferably has a short apron that spaces the field of the base member from the shelf and thereby improves circulation, especially for glass or solid shelves. The slots are arranged in columns extending between the front and rear portions and include at least first, second and third columns 16, 18, 20 spaced from one another between the side edges of the base member.

A left side panel 22 has a plurality of downwardly extending feet 24 protruding through slots in the first column of slots 16 to connect side panel 22 to base member 14. Each foot has a backward 'L' shape with the short portion of the 'L' pointing toward the front of the base member so that each foot engages the front edge of a slot to lock the side panel in position. Once locked into position, the forces exerted on the bottles and by the bottles keep the side panel locked in position. The base member apron has sufficient height to ensure that the refrigerator shelf does not interfere with the feet.

A right side panel 26 also has a plurality of downwardly extending feet 28 protruding through slots in the second or third column of slots 18, 20 to connect side panel 26 to base member 14. The choice of columns of slots depends on the size or contour of the bottles; so, one unit accommodates bottles of different sizes and contours. Each foot has a backward 'L' shape with the short portion of the 'L' pointing toward the front of the base member so that each foot engages the front edge of a slot to lock the side panel in position. Once locked into position, the forces exerted on the bottles and by the bottles keep the side panel locked in position.

The display device 10 also has left and right posts 30, 32 and a flexible front stop member 34. Left post 30 is attached to left side panel 22. Left post 30 has a downwardly extending foot protruding through a slot in the first column of slots 16. Side panel 22 and post 30 may be integrally formed along with the flexible front stop member 34. It may be advantageous, however, to separately form front stop member 34 to achieve a more compact package for shipping. Similarly, right post 32 is attached to right side panel 24. Right post 32 has a downwardly extending foot protruding through a slot in one of the second and third columns of slots 18, 20.

The front stop member 34 is attached to both posts 30, 32 and extends laterally across the front of display device 10 above base member 14 to halt forward progress of the bottles 12 and ready a single bottle for removal. Front stop member 34 may be constructed of a piece of plastic material that is curved to fit the contour of a bottle. To accommodate different sizes of bottles, the material must be flexible enough to change from one curve diameter to another as the side panels and posts are changed from one column of slots to another. This allows a single display device to adapt to variations in size and shape common among various product brands. Naturally, the length of the front stop member is greater than the spacing between the posts to adopt the contour of the lead bottle. It is possible to have a front stop member so flexible that it is string-like completely adapting to the front contour of the lead bottle. Preferably, front stop member 34 has upper and lower stop members 36, 38 attached to one another by a vertical connecting ribs 40 on each end.

When separately formed, a post, such as post 32, may have a front face defining a front slot or keyway 42 to accept a rib 40 of the front stop member 32 with rib 40 acting as a connecting key. A rear face defines a rear keyway 44 that accepts a connecting key 46 formed on the front end of side panel 26. Separately formed members provide the greatest shipping and storing flexibility.

Referring to FIGS. 1–2, left side panel 22 has a push out panel or tab 48 that can be dislodged from its normal position flush with the surface of side panel 22 to a position in the channel to help prevent bottles from being pushed out the back of the shelf. Tab 48 is useful when the device is used on a gravity feed shelf without a pusher. The tab increases the force required to push bottles out the rear of the device. While shown as part of the left side panel, a tab could be used on the right side panel instead or additionally.

Still referring to FIGS. 1–2, a pusher mechanism 50 is attached to left side panel 22 which acts as a rail for the pusher mechanism. Such pusher mechanisms are more fully described in U.S. Pat. Nos. 5,562,217 and 5,634,564, the disclosures of which are incorporated herein by reference. Where pusher 50 is attached to a side panel, the feet of the panel are spaced to accommodate the pusher.

Figure 3:
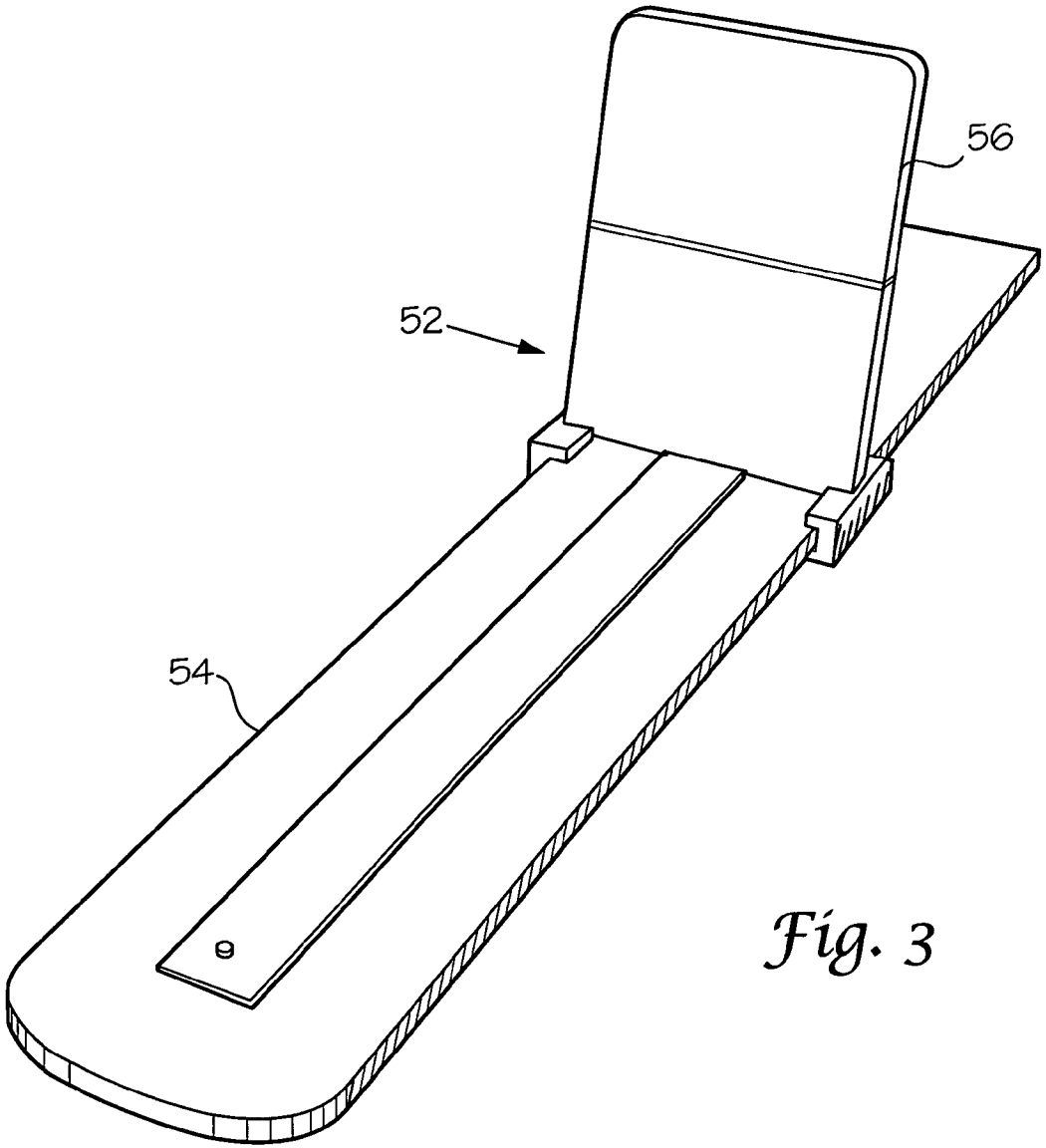
FIG. 3 is a perspective view of a bottom pusher mechanism for the track device of FIG. 1.

Referring to FIG. 3, a pusher mechanism 52 is positioned on the base member. The pusher mechanism includes a bottom rail 54 that rests on or is attached to the base member and an upright panel 56 that actually pushes product forward.

Referring now to FIGS. 4 and 6, a device 58 for two columns of bottles is illustrated. It features two track devices side-by-side. In FIG. 4, the two devices share a common sidewall 60 that has a front rib 62 with dual keyways formed therein to receive keys of two front stop members 64, 66. In this arrangement, width adjustments are made by moving the outer sidewalls 68, 70 to a different column of base member openings with the common wall remaining stationary. In this arrangement front rib 62 and common sidewall 60 are integrally formed. FIG. 6 features a common post 72 having a rear face defining first and second keyways for receiving keys of separate side panels 74, 76 instead of a common side panel.

It can now be appreciated that a merchandising display device has been presented that has a flexible front stop member that allows the device to accept beverage containers of different sizes and contours. The present invention provides side panels forming chambers to maintain beverages bottles in neat columns and provides a plurality of openings that aid ventilation. Different diameter bottles can be accommodated because the front stop member is flexible. Moving a side panel from one column of openings to another to adjust channel width and cause the flexible front stop member to adjust its curvature to fit the width.

While the invention has been described with particular reference to the preferred embodiments, it will be understood by those skilled in the art that various changes may be made and equivalents may be substituted for elements of the preferred embodiments without departing from invention. For example, the height of the front stop member can be made of clear, transparent material and of a height sufficient to keep bottles from tipping over but not so high as to obscure product labeling.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A merchandising display device comprising:

a base member having front and rear portions, opposed side edge portions and a plurality of slots, said slots being arranged in columns extending between said front and rear portions, said columns including at least first, second and third columns spaced from one another between said side edge portions;

a first upstanding side panel having a plurality of downwardly extending first side panel feet protruding through slots in said first column connecting said first side panel to said base member;

a first vertical post attached to said first side panel;

a second upstanding side panel spaced from said first side panel, said second side panel having a plurality of downwardly extending second side panel feet protruding through slots in one of said second and third second columns connecting said second side panel to said base member, said second side panel moving between said second and third columns of slots to vary the spacing between said first and second side panels;

a second vertical post attached to said second side panel; and a deformable front stop member attached to each of said first and second vertical posts, said front stop member deforming to adapt to the spacing between said first and second side panels as said second panel moves between said second and third columns of slots.

2. A merchandising display device, as set forth in claim 1, wherein said first post has a downwardly extending first post foot protruding through a slot in said first column.

3. A merchandising display device, as set forth in claim 1, wherein said second post has a downwardly extending second post foot protruding through a slot in one of said second and third columns.

4. A merchandising display device, as set forth in claim 1, wherein said first side panel and said first post are formed as a single continuous unit.

5. A merchandising display device, as set forth in claim 1, wherein said first side panel, first post and front stop member are formed as a single continuous unit.

6. A merchandising display device, as set forth in claim 1, wherein said second side panel and second post are formed as a single continuous unit.

7. A merchandising display device, as set forth in claim 1, wherein said second vertical post has a front face defining a keyway and said front stop member has a vertical rib defining a key, said key fitting in said keyway and attaching said front stop member to said second. post.

8. A merchandising display device, as set forth in claim 1, wherein said second vertical post has a rear face defining a keyway and said second upstanding side edge panel has a rib defining a key, said key fitting in said keyway.

9. A merchandising display device, as set forth in claim 1, wherein said front stop member includes an upper stop member and a lower stop member.

10. A merchandising display device, as set forth in claim 9, wherein said upper and lower stop members are attached to one another by a connecting rib.

11. A merchandising display device, as set forth in claim 1, wherein said first upstanding side panel includes a push out tab.

12. A merchandising display device, as set forth in claim 1, including a pusher mechanism attached to said first upstanding side panel.

13. A merchandising display device, as set forth in claim 1, including a pusher mechanism attached to said base member.

14. A merchandising display device for displaying a row of articles, comprising:

a base member having front and rear portions, opposed side edge portions and a plurality of slots, said slots being arranged in columns extending between said front and rear portions, said columns including at least first, second and third columns spaced from one another between said side edge portions;

a first upstanding side panel having a plurality of downwardly extending first side panel feet protruding through slots in said first column connecting said first side panel to said base member;

a first vertical post attached to said first side panel;

a second upstanding side panel spaced from said first side panel, said second side panel having a plurality of downwardly extending second side panel feet protruding through slots in one of said second and third second columns connecting said second side panel to said base member;

a second vertical post attached to said second side panel;

a deformable first front stop member attached to each of said first and second vertical posts, said second post having a front face defining first and second keyways and said first front stop member having a rib defining a key, said key fitting in said first keyway; and a second front stop member having a second rib defining a second key, said second key fitting in said second keyway.

15. A merchandising display device for displaying a row of articles, comprising:

a base member having front and rear portions, opposed side edge portions and a plurality of slots, said slots being arranged in columns extending between said front and rear portions, said columns including at least first, second and third columns spaced from one another between said side edge portions;

a first upstanding side panel having a plurality of downwardly extending first side panel feet protruding through slots in said first column connecting said first side panel to said base member;

a first vertical post attached to said first side panel;

a second upstanding side panel spaced from said first side panel, said second side panel having a plurality of downwardly extending second side panel feet protruding through slots in one of said second and third second columns connecting said second side panel to said base member;

a second vertical post attached to said second side panel;

a deformable first front stop member attached to each of said first and second vertical posts, said second post having a rear face defining first and second keyways and said second side panel having a rib defining a key, said key fitting in said first keyway; and a third side panel has a rib defining a key, said key fitting in said second keyway.

* * * * *